US005873914A

United States Patent [19]

Burkinshaw et al.

[11] Patent Number: 5,873,914

[45] Date of Patent: Feb. 23, 1999

[54] METHOD FOR DYEING SYNTHETIC MATERIALS WITH VAT DYESTUFFS

[75] Inventors: Stephen M. Burkinshaw; Philip J. Brown, both of Leeds, Great Britain

[73] Assignee: The Secretary of State for Defence in Her Britannic Majesty's Government of the United Kingdom of Great Britain & Northern Ireland, United Kingdom

[21] Appl. No.: 765,182

[22] PCT Filed: Jul. 25, 1995

[86] PCT No.: PCT/GB95/01755

§ 371 Date: Jan. 14, 1997

§ 102(e) Date: Jan. 14, 1997

[87] PCT Pub. No.: WO96/04420

PCT Pub. Date: Feb. 15, 1996

[30] Foreign Application Priority Data

Jul. 29, 1994 [GB] United Kingdom ..... 9415302
Mar. 31, 1995 [GB] United Kingdom ..... 9506691

[51] Int. Cl.[6] ..... D06P 1/22; D06P 3/24; D06P 3/40; D06P 3/52

[52] U.S. Cl. ..... 8/650; 8/921; 8/922; 8/924; 8/925; 8/926

[58] Field of Search ..... 8/650, 921, 922, 8/924, 925, 926

[56] References Cited

U.S. PATENT DOCUMENTS 5,607,483 3/1997 Burkinshaw et al. ..... 8/650

FOREIGN PATENT DOCUMENTS 1-168980 7/1989 Japan .

3-76880 4/1991 Japan .

OTHER PUBLICATIONS

Baumgarte Melliand Textile Reports, Mar. 1987, pp. 189–195 "Reduction and Oxidation processes in Dyeing with Vat Dyes".

Baumgarte Melliand Textile Reports 68 (no month available 1987) pp. 187–195 "Reduction and Oxidation processes in Dyeing with Vat Dyes".

Baumgarte 4052 Review of Process in . . . 17 (no month available 1987) Developments in Vat Dyes and in their application 1974–1986.

Aspland 2248 Textile Chemist and Colorist 24 ( 1992 Jan.), No. 1, Triangle Part, NC "Chapter 3: Vat Dyes and their applications".

*Primary Examiner*—Margaret Einsmann
*Attorney, Agent, or Firm*—Nixon & Vanderhye

[57] ABSTRACT

A method is provided for dyeing a non-cellulosic organic material with a dye, preferably a vat dye, comprising (a) treating the material with a dye in the presence of a reducing agent and an alkali and (b) oxidising the treated material produced in step (a) characterised in that the concentration of reducing agent used in step (a) is increased above that used for conventional vat dyeing such that the resultant dyed material has a lightfastness of 5 or more by BS 1006 B01 and B02 (1978) and/or has a washfastness or 5 or more by British Standard Test BS 1006 C06.C2 (1981). Preferably the step (a) is carried out in the presence of an alkali in concentration of at least 0.5 molar, more preferably 1 molar or more and most preferably 1 to 4 molar. The method provides vat dyed non-cellulosic organic materials having a reflectance of infrared light of wavelength 400 nm to 680 nm of less than 15%.

26 Claims, No Drawings

METHOD FOR DYEING SYNTHETIC MATERIALS WITH VAT DYESTUFFS

The present invention relates to a novel methods for dyeing non-cellulosic organic materials, such as nylon, polyester, acetates, acrilan, viscose, polyolefins, polyurethanes and polyarylamides. It also relates to dyed materials, particularly to novel dyed non-cellulosic organic materials having improved properties achievable by means of the dyeing process.

Conventional vat dyeing methods are well known to be incapable of providing satisfactory lightfastness and washfastness when used with synthetic fabrics, for example nylon and polyester. This causes problems when applying such dyes to synthetic materials commercially. Car interiors and upholstery, and curtains and drapes in homes, trains and ships often comprise synthetic fabrics that by their nature are exposed to bright sunlight for long periods. Hardwearing synthetic carpets, particularly those in communal areas, require good light and shampoo fastness, yet often include metal based compounds to increase light fastness that are washed out with cleaning. Furthermore, modern synthetic fabrics such as microfibre nylon, polyurethanes such as Lycra (RTM) and polyarylamides such as Kevlar (RTM) and Nomex (RTM) are notoriously difficult to dye. With fibres of materials such as Lycra it is conventional to blend them with fibres of more easily dyed material eg. cellulosic fibres such as cotton, in order to allow satisfactory dyeing to be achievable.

The option of applying vat dyes to synthetic materials such as nylon, Kevlar (RTM), Nomex (RTM), polyolefins, polyurethanes and polyester with the prospect of wash- and lightfastness been discounted in the art; see for example "Textile Printing with Caledon, Durindone and Soledon Dyes" (1961) p391, paragraph 17.9 and "Dyeing Synthetic Polymers and Acetate Fibres", Ed D M Nunn, Dyers Company Publication Trust 1979.

The dyeing synthetic materials is also important in specialised areas eg. the provision of clothing for service personnel. In this field materials are also dyed to improve their near infra-red camouflage characteristics by reducing reflectance at certain atmospheric 'window' wavelengths. On cotton and cellulosic blended fibre fabrics this can be readily carried out by vat dyeing as vat dyes comprise large conjugated ring structures which confer correct reflectance properties. However, it has always been difficult to achieve near infra-red reflectance camouflage with synthetic materials such as nylon and polyester as the dyes which are effective in colouring them comprise relatively small molecules.

Use of small concentrations of black vat dye on cottons is sufficient to control near infra-red properties. However, using standard vat dyes and vat dyeing conditions it has hitherto not been possible to achieve light fastness of greater than 5 (British Standard Test BS 1006: (1978) B01:B02) when dyeing nylon, while wash fastness at 60° C. has been limited to 4 to 5 (British Standard Test BS 1006: 1978: C06). Thomas Vickerstaff 'The Physical Chemistry of Dyeing' (1968) 2nd Edition, p479, Table 125 shows lightfastness of vat dyed nylon to be no better than 2 to 3 for a range of colours where the corresponding cotton has fastness of 5 to 8.

In order to render nylon filament fabrics near infra-red camouflaged several techniques have been applied. A first one of these techniques incorporates carbon black pigment into the printing paste. However the carbon is difficult to apply and the low reflectance fastness is poor. In a second method of more limited application pigments are indirectly applied by incorporation into polymer coatings or membranes applied to the fabric. A third method includes a proportion of black pigmented nylon yarns into woven structures, thus necessitating careful weaving to completely mask them in the final product. All these techniques cause problems in production and are inconvenient.

Specialised dyed materials have been produced, as described in JP03076880, although the method described is not generally applicable and only a small group of particular materials can be dyed according to it. The lightfastness of dyed materials has also been improved by a resteaming process as described in DE 901168. However, this requires the addition of an extra step to the dyeing process which increases both the complexity and the cost involved.

There is thus an on-going need for a dyeing process that can apply dyes, and particularly vat dyes to synthetic fabrics that will provide good or excellent light- or washfastness, and in the military field, low infra-red reflectance. In particular there is a need for such methods to be simple to perform and to be generally applicable to synthetic materials. The term 'vat dye' will be well known to those skilled in the art, but generally covers reducible dyes such as indigos and anthraquinoids which have to be reduced to their leuco form and applied from a neutral or alkaline matrix, ie. a solution or paste, before being reoxidised to provide their colouring effect. Such dyes may be used for bath dyeing, ie. by immersion of fabric in aqueous dye solutions, and for printing in the form of pastes.

The present inventors have now provided a novel method for applying dyes, and in preferred forms vat dyes, which leads to improved light and wash fastness when applied to non-cellulosic organic materials, particularly fibres, and thus provides a method for imparting suitable infra-red reflectance values to such materials by simple printing or immersion procedures. Furthermore their invention provides novel dyed, preferably vat dyed, non-cellulosic organic materials having light and/or wash fastness values increased with regard to previously attained values, in preferred embodiments being 5 or more by British Standard Test BS1006 B01 and B02 (1978) for light fastness and 5 or more for BS1006 C06.C2 (1981) for wash fastness.

Thus in a first aspect of the invention there is provided a method dyeing a non-cellulosic organic material with a dye comprising (a) treating the material with a dye in the presence of a reducing agent and an alkali and;

(b) oxidising the treated material produced in step (a)

characterised in that the concentration and/or reduction potential of the reducing agent and the concentration of the alkali used in step (a) is increased above that used for conventional vat dyeing such that the resultant dyed material has a lightfastness of 5 or more by BS1006 B01 and/or B02 (1978) and/or has a washfastness of 5 or more by British Standard Test BS1006 C06.C2 (1981) and/or the dyed material has a reflectance of light of wavelength 400 nm of 20% or less, preferably 15% or less, more preferably 10% or less and most preferably 5% or less. More preferably the dyed material has such low reflectance properties with respect to light over the wavelength range 400 to 700 nm. The present method is able to achieve these properties in the material in its 'as dyed' state, that is there is no requirement for further treatment eg. steam treatment. The materials provided by the method may optionally be further treated by any conventional method prior to use.

It will be realised that for black dyeings the reflectance will be less than for other colours, particularly than bright colours such as yellows, and particularly as the wavelength of reflected light increases. For military uses the present invention particularly provides preferred dyed non-cellulosic organic materials which when the dye is khaki have a reflectance at between 700 and 1200 nm of 65% or less; when the dye is green have a reflectance at between 700 and 1200 nm of 50% or less; when the dye is brown have a reflectance at between 700 and 1200 nm of 27.5% or less and when the dye is black have a reflectance at between 700 and 1200 nm of 12.5% or less.

Preferably the dye used in step (a) is a vat dye, but the present inventors have determined that the technique will produce dyeing using other dyes, eg. even acid dyes, even though such dyes are not being used in their normal pH medium. A preferred vat dye used in the present invention is a Vat Black dye.

The method can suitably be performed by immersion in an aqueous solution of alkali and reducing agent at a temperature of between 90° C. and 100° C. The dyeing step (a) also may be carried out using dye, alkali and reducing agent in a solution or in the form of a paste suitable for printing, and step (a) is conventionally performed at elevated temperature. Where the composition is a paste, the elevated temperature used will be dependent upon the paste components, eg. steam may be used at 100° C. to 140° C. Where a solution is used step (a) is preferably carried out at between 90° C. and 120° C., more preferably at 95° C. to 110° C.

The oxidation step (b) may be carried out by conventional vat dyeing oxidation techniques. For example, where step (a) is carried out in solution, step (b) may be conveniently carried out by use of an aqueous solution of oxidising agent, eg. such as potassium dichromate/acetic acid mixture, at elevated temperature, eg. about 65° C. for this mixture. Air or oxygen gas mediated oxidation may also be used.

Oxidation is preferably carried out after rinsing the fibrous material provided by step (a). After oxidation the material is preferably rinsed in water then soaped in an aqueous soap solution, preferably with boiling, to remove excess dye. The periods required for each of these steps will vary with the materials and conditions used, but for nylon step (a) may for example be performed for 45 to 75 minutes at about 95° C., step (b) for 15 to 45 minutes at 65° C., and soap treatment performed for 5 to 15 minutes with boiling.

Conventional vat dyeing compositions of solution type where fabrics are immersed therein typically comprise about 0.01 to 0.02 molar sodium hydroxide and 0.3 molar sodium dithionite or equivalent reducing agent such as a Rongalite. (see eg Ciba Geigy Cibanone dye manufacturer's instructions). The preferred molarity of alkali, eg. sodium hydroxide, used in the present solution method is in excess of 0.5 molar, more preferably 1 molar or more and most preferably between 1 and 4 molar.

The maximum concentration of alkali will vary, primarily being limited by the susceptibility of the particular material being dyed to tenderising, but will conveniently normally need be no more than 2 molar in a immersion dyeing method and 4 molar in printing pastes. For nylon a typical sodium hydroxide strength for step (a) is 1.33 molar using immersion and about 3 molar in a paste for printing. Thus whereas conventional vat dyeing uses pH of 12–13, the present method uses pH above pH 13, more preferably about pH 14, with the result that a more permanent light and washfast dyeing is effected.

The preferred molarity of reducing agent when sodium dithionite is being used in step (a) of the present method in solution form is 0.015 molar or more, more preferably 0.3 molar and most preferably above 0.6 molar or more. Conveniently up to 2 molar sodium dithionite or its equivalent might be used, but no particular upper limit is envisioned as materials may vary in ability to withstand such levels.

The ratio of reducing agent to alkali in step (a) is preferrably greater than the reducing equivalent of 0.001 moles sodium dithionite per 0.01 moles sodium hydroxide or equivalent alkali for 0.1 to 10 grams vat dye.

It will be realised that the type or amount of reducing agent required may vary with its efficacy, ie. reduction potential, the dye used, the fibrous material which it is intended to dye and the choice of printing or wet dyeing. Thus for 1.5 g Taslan nylon fabric it has been found that, using 3 molar sodium hydroxide and a total of 7 g CI vat black dyes, 3 grams of sodium dithionite (0.0124 moles) in 80 mls may be comfortably used to produce a material of the invention, as can 3 grams of any of Rongalite C, Rongalite HT, Rongalite DP, Rongalite FD, Rongal PS 91 and Rongal HT 91, in similar volumes. However Rongalite H liquid, Rongalite ST liquid, and Rongalite 2PH-A/B are less effective than the others at concentrations of 5 grams using these conditions. Using typical conditions described above the present inventors have been able to dye nylon with acid dyes, although the colours provided are altered as compared to that produced using acid dyeing techniques.

For use with printing, increased amounts of alkali and optionally reducing agent will be required to be incorporated into the printing paste. Where sodium dithionite is the reducing agent, it may be added as pastes such as those described in EP 0140218 with the amount of sodium dithionite increased to a level that will be readily determined by simple bench experimentation. Other suitable vat dye/reducing agent/alkali paste formats will occur to those skilled in the art; eg. see WO 9406961, WO 9209740, JP 63182482, JP 63159586, EP 0162018 (foam paste), GB 2152037, JP 92001118, CH 662695, JP 87008556B, DE 4206929, EP 0162018, JP 58060084, JP 85030792 and EP 0021432.

The paste may comprise the dye, eg. vat dye, in leuco-salt form, such as those described in JP 94035715, modified such that the alkali and reducing agent components are strong enough to achieve the desired effect. Other printing compositions, such as those incorporating materials which allow screen printing, eg. of contact lenses, may also be so modified (eg JP 1188824 and JP 63264719). A preferred paste comprises a thickening agent and includes the dye, eg. vat dye, alkali (eg. as potassium or sodium hydroxide) and reducing agent eg. as sodium dithionite or a Rongal or Rongalite. Such pastes are known to be used on cellulose materials and broadly suitable pastes are disclosed in SU 1686049 and SU 1143786 for vat dyeing cellulose.

The method of the invention is preferably used to dye a synthetic organic material, more preferably a material is selected from a polyarylamide (Kevlar or Nomex (RTMs)), nylon, polyester, polypropylene, polyurethane, acetate, 2°-acetate, triacetate and acrilan. In a preferred embodiment of the invention the method is used to dye a nylon microfibre material.

The inventors have successfully dyed the fibres and/or fabrics of the following materials using the preferred compositions of the invention for performance of the reducing step (a): nylon, polyester, secondary acetate, triacetate, kevlar, acrilan, polypropylene, polyurethane (Lycra) and viscose. Cotton will also dye using the method but such method is of course not part of the present invention. The method dissolves wool and tenderises acetate, acrilan, viscose and triacetate if excessively high amounts of alkali are used. Use of optimised methodology resulted in perfect BS1006 '5' scores (see below) for washfastness for each of cotton, polyester, kevlar and nylon; the latter being provided even for nylon microfibre which is known to have poorer washfastness than conventional nylon.

It will readily be seen from the examples provided hereinbelow that the present inventors have provided a method that is capable of fundamentally changing the nature of dyed non-cellulosic products, particularly dyed synthetic fibre materials, eg. vat dyed materials, such that their washfastness, light fastness and reflectance may all be altered from that which is usually associated with dyeing and particularly vat dyeing. While the precise chemical nature of the product fibre/dye after dyeing is not at present known to them, it is clear that they have provided novel dyed materials, eg. fibres and fibrous materials having properties not previously provided.

Thus a further aspect of the present invention provides a vat dyed non-cellulosic organic material having a washfastness of at least 5 by British Standard Test BS1006 C06:C2 (1981) and/or lightfastness of 5 or more by British Standard Test BS1006 B01 and B02 (1978). More preferably the material has a lightfastness of 7 or more by British Standard Test BS1006 B01 and B02 (1978). the invention also provides materials obtainable by the novel method.

Furthermore the present invention provides fibres and fabrics, and items covered with these, including carpets, car interior furnishings and covers, upholstery, curtains and drapes and microfibre fabric items, having any one or more of these three washfastness, lightfastness and low reflectance properties. It will be realised that materials other than fibres and fabrics may be so dyed using the method of the invention, eg. nylon automobile interior furnishings and fittings such as dashboards, panels etc.

A particular advantage of the method and dyed products of the invention is that they allow certain relatively new materials, such as polyarylamides, polyurethanes and nylon microfibres to be employed in dyed condition without the need to compromise their inherent characteristics by blending them with other materials such as cellulosic materials.

The methods and materials of the invention will now be described further by way of illustration only by reference to the following non-limiting Examples. Further embodiments of the invention will occur to those skilled in the art in the light of these.

EXAMPLES

Example 1

Method of dyeing Nylon fabric using Rongal HT reducing agent and CV Vat Black 27, CI Vat Yellow and CI Vat Green dyes Nylon fabric (1.5 g) was dyed for 45 minutes at 95° C. in a bath solution comprising CI Vat Yellow (1 ml of a 1.6% aqueous solution), CI Vat Black 27 (10 ml of a 5% aqueous solution) and CI Vat Green (1 ml of a 1.6% aqueous solution) with 13 ml of a 4M aqueous sodium hydroxide solution, 4.5 g Rongal HT (BASF) and water (60 ml). Sodium hydroxide final concentration was approximately 0.6 molar.

At the end of this period the fabric was rinsed in water and oxidised using 75 ml of an aqueous solution of potassium dichromate (1.5 g) and acetic acid (15 g) for 30 minutes at 65° C. The oxidised fabric was rinsed in water and soaped in 75 ml of an aqueous solution containing soap flakes (3.75 g) with boiling for 10 minutes. The infra-red reflectance of the ensuing green sample is sufficiently low to meet NATO (STANAG) green infra-red reflectance standards and is 10% or below between 400 nm and 680 nm wavelength and less than 47.5% between 680 and 1000 nm wavelength.

Example 2

Method of dyeing Nylon fabric using Rongal HT reducing agent and CV Vat Yellow 33 and CV Vat Black 27 dyes Nylon fabric (1.5 g) was dyed for 45 minutes at 95° C. in an aqueous solution comprising CI Vat Yellow 33 (1 ml of a 3% aqueous solution), CI Vat Black 27 (25 ml of a 5% aqueous solution) with 13 ml of a 4M aqueous sodium hydroxide, 4.5 g Rongal HT and water (60 ml). Sodium hydroxide final concentration was approximately 0.5 molar.

At the end of this period the fabric was rinsed with water and oxidised and soaped as described in Example 1. The infra-red reflectance of the ensuing green sample is sufficiently low to meet UK MoD reflectance specifications, being 10% or below between 400 nm and 680 nm and below 47.5% between 680 nm and 1000 nm.

Example 3

Dyeing of Nylon using Ronzal HT and CI Vat Black 27 dye to produce a Khaki coloured fabric The ability of the present method to produce different colours and shades using the same Black dye was illustrated by dyeing nylon fabric (1.5 g) for 45 minutes at 95° C. in an aqueous solution comprising CI Vat Black 27 (2 ml of a 5% aqueous solution), sodium hydroxide (10 ml of a 4M aqueous solution), Rongal HT (BASF)(3 g) and water (60 ml).

The treated sample was rinsed, oxidised and soaped as described in Example 1. The reflectance values between 700 nm and 1200 nm were found to be 60% or below and suitable for UK MoD use.

Example 4

Dyeing of Nylon using Rongal HT and CI Vat Brown 33 dye

Nylon fabric (1.5 g) was dyed for 45 minutes at 95° C. in an aqueous solution comprising CI Vat Brown 33 (4.5 g), sodium hydroxide (25 ml of an 8M aqueous solution), Rongal HT (BASF) (5.5 g) and water 50 $cm^3$. Final sodium hydroxide concentration was 2.7 molar. The treated sample was rinsed, oxidised and soaped as described in Example 1 and the infra-red reflectance of the dark brown product found to meet UK MoD reflectance requirements, having reflectance below 25% between 400 nm and 1200 nm.

Example 5

Dyeing of Nylon using Rongal HT and CI Vat Black 30 and CI Vat Black 25 dyes

Nylon fabric (1.5 g) was dyed for 45 minutes at 95° C. in an aqueous solution comprising CI Vat Black 30 (4 g), CI Vat Black 25 (2.5 g), sodium hydroxide (30 $cm^3$ of an 8M aqueous solution), Rongal HT (5 g) amd water (50 $cm^3$). Final sodium hydroxide concentration was 3 molar.

The treated sample was rinsed, oxidised and soaped as described in Example 1 and the infra-red reflectance of the resultant black product found to meet UK MoD requirements; the reflectance being 10% or below between 400 and 1200 nm.

Example 6

Dyeing of Taslan fabric using sodium dithionite and CI Vat Black 25 and CI Vat Black 30 dyes Taslan Nylon fabric (1.5 g) was dyed for 45 minutes at 95° C. in an aqueous solution comprising CI Vat Black 30 (4.5 g), CI Vat Black 25 (2.5 g), sodium hydroxide (30 $cm^3$ of an 8M aqueous solution), sodium dithionite ($Na_2S_2O_4$-Vickers Laboratory) (3 g) and water (50 $cm^3$). Final sodium hydroxide concentration was 3 molar. The treated sample was rinsed, oxidised and soaped as described in Example 1 and the infra-red reflectance of the resultant black product found to meet UK MoD requirements; the reflectance being 10% or below between 400 and 1200 nm.

Example 7

Dyeing of Nylon fabrics using various reducing agents with the dyes of Example 6

The dyeing process of Example 6 was repeated on 1.5 g samples of Nylon (Taslan) fabric with a variety of different reducing agents of the BASF Rongal and Rongalite family in place of the sodium dithionite. These agents are of nature as set out in Table 1.

TABLE 1

| Reducing agent | Nature |
|---|---|
| Rongalite H liquid | Sulphoxylate derivative |
| Rongalite ST liquid | Sulphinic acid salt deriv' |
| Rongalite 2PH-B liquid | 2PH-A inorganic |
| Rongalite 2PH-A solid | 2PH-B aliphatic sulphonic deriv' |
| Rongalite C | Hydroxymethanesulphinite salt |
| Rongalite HT | Sulphoxylic acid deriv' |
| Rongalite DP | Hydroxymethanesulphinate mix |
| Rongalite FD | Sulphoxylic acid deriv' |
| Rongal PS 91 | Sulphoxylic acid deriv' |
| Rongal HT 91 | Sulphoxylic acid deriv' |

From this study each of Rongalite C, HT, DP, FD and Rongal PS91 and HT91 were found to be sufficiently strong reducing agents at 3 g in 80 mls at 95° C. to produce the required reflectance values of 10% or less between wavelengths of 400 nm and 1000 nm. Rongalite 2PH-B liquid (3 g) mixed with Rongalite 2PH-A solid was found to be incapable of achieving the military reflectance (being over 10% between 900 and 1200 nm) as were Rongalite ST and H liquids (5 g in each case) but otherwise effect a dyeing according to the invention.

Example 8

Dyeing of nylon microfibre using varying amounts of reducing agent

The effect of varying sodium dithionite concentration in the recipe of Example 6 was determined for dyeing of 1.5 g Nylon microfibre samples by reference to colour loss as measured by a reflectance spectrophotometer. Results are shown in Table 2 below.

TABLE 2

| Dithionite (grams) | 400 nm Reflectance (%) | 400 nm Reflectance after CO6O2 wash | Difference |
|---|---|---|---|
| 0.12 | 25.24 | 31.22 | 5.98 |
| 0.25 | 15.22 | 17.41 | 2.19 |
| 0.53 | 10.73 | 11.29 | 0.56 |
| 1.00 | 3.89 | 4.01 | 0.12 |
| 2.00 | 4.02 | 4.17 | 0.15 |

These results were obtained using 10 ml of 8M sodium hydroxide and 60 $cm^3$ water, using the dyes of Example 6, thus providing a sodium hydroxide concentration of about 1.14 molar, as compared with a typical vat dye recipe of about 0.015 molar.

The results show that when sodium dithionite is below 1 g in 70 mls of liquor the loss of colour from the fabric becomes significant on washing, thus that some change has occurred which alters the properties of the dyed fabric at around this concentration.

Example 9

Dyeing of Nylon microfibre using varying amounts of alkali (sodium hydroxide)

The effect of varying sodium hydroxide concentration while maintaining optimal (2 g in 60–70 ml) dithionite concentration was studied using the dyes and other conditions as set out in Example 6. Results are set out in Table 3.

These figures correspond to 0, 0.2, 0.32, 0.62 and 1.14 molar sodium hydroxide (approximately) in each case. Thus it is clear that with optimised reducing agent concentration, the increase of sodium hydroxide from 0.2 to 0.32 molar provides a significant change in the reflectance of the microfibre product whereby a washfastness to BS 1006 C06 02 score '5' is provided, with reflectance being stable at below 5% at 400 nm.

TABLE 3

| 8M NaOH (mls) | Reflectance 400 nm (%) | Reflectance 400 nm after CO6 C2 wash | Difference |
|---|---|---|---|
| 0 | 33.54 | 50.20 | 16.66 |
| 1.25 | 9.65 | 14.49 | 4.99 |
| 2.5 | 3.61 | 3.7 | 0.09 |
| 5 | 3.45 | 3.67 | 0.22 |
| 10 | 4.02 | 4.17 | 0.15 |

The transfer of stain to adjacent fabrics was tested and found not to be significant when the dyeing method as set out above was used on microfibre or cotton. Two samples obtained with microfibre in Example 8 (0.12 and 0.25 g dithionite) and two samples in Example 9 (0 and 1.2 ml of NaOH) produced noticeable colour loss in the washfastness test liquor. No dye appeared with any of the other samples.

Example 10

Dyeing of Taslan nylon: reflectance, washfastness and lightfastness

Taslan nylon, having melting point 264° C. and melting endotherm 90 J/g, was used for this study. Taslan (1.5 g) was dyed for 45 minutes at 95° C. in a solution of CI Vat Black 30 (4 g), CI Vat Black 25 (2.5 g), 30 ml of 8M sodium hydroxide, Rongal HT (5 g) and water (50 ml). Final molarity of sodium hydroxide was 3 molar.

After rinsing the sample was oxidised at 65° C. for 30 minutes in a 75 ml aqueous solution which contained $K_2Cr_2O_7$ (1.5 g) and acetic acid (15 g). After rinsing the sample was washed with boiling in 75 ml of water containing 3.75 g of soap flakes for 10 minutes. The visible and infra-red reflectance spectra of the sample provided is shown in Table 4 below. Performance of lightfastness test BS1006 ISO/R B01 and B02 as described below gave a rating of 7+ and performance of the washfastness test BS1006 ISO/R C06C2 gave a score of 5, thus demonstrating the unique nature of the product according to the invention. This nylon was particularly suited to use in the provision of automobile interiors wherein a need for lightfast black nylon upholstery and other interior items is present; current black dyed nylons being only of lightfastness score of between 4 and 5.

TABLE 4

| Wavelength | Reflectance | Wavelength | Reflectance |
|---|---|---|---|
| 400 nm | 3.01% | 420 nm | 3.03% |
| 440 nm | 2.97% | 460 nm | 2.94% |
| 480 nm | 2.94% | 500 nm | 2.89% |
| 520 nm | 2.90% | 540 nm | 2.90% |
| 560 nm | 2.94% | 580 nm | 2.92% |
| 600 nm | 2.95% | 620 nm | 2.95% |
| 640 nm | 2.97% | 660 nm | 2.95% |
| 680 nm | 2.91% | 700 nm | 2.26% |

TABLE 4-continued

| Wavelength | Reflectance | Wavelength | Reflectance |
|---|---|---|---|
| 720 nm | 2.27% | 740 nm | 2.32% |
| 760 nm | 2.34% | 780 nm | 2.36% |
| 800 nm | 2.37% | 820 nm | 2.72% |
| 840 nm | 2.66% | 860 nm | 2.86% |
| 880 nm | 3.28% | 900 nm | 3.21% |
| 920 nm | 3.22% | 940 nm | 3.31% |
| 960 nm | 3.34% | 980 nm | 3.59% |
| 1000 nm | 3.66% | | |

Example 11

Use of increased alkali/increased reducing agent method on kevlar, polyester, 2° acetate, triacetate, wool, acrilan, polypropylene, viscose, nylon, and cotton: comparison The following protocol was carried out using 1.5 g of each of the following materials in fibre form: Kevlar, polyester, 2° acetate, triacetate, wool, acrilan, polypropylene, viscose and cotton.

Fabrics were dyed at 95° C. for 45 minutes using 1 g Vat Brown 33, 2 g Rongal HT, 50 ml 4M sodium hydroxide and 25 ml of water giving a final sodium hydroxide concentration of 2.64 molar. The dyed samples were oxidised for 30 minutes at 65° C. using 75 ml of a solution containing 20 g/liter of potassium dichromate ($K_2Cr_2O_7$) and 190 g/l of acetic acid.

The oxidised fabrics were then soaped for 15 minutes at 100° C. in a solution containing 75 ml of water and 3.75 g of soap flakes.

All of the fabrics referred above were dyed to some degree except wool since this dissolved in these conditions. All fabrics were visually dyed brown except cotton which dyed black. Polyester and polypropylene fibres only dyed to light shades using this particular recipe and the conditions used tenderised acetate, triacetate, viscose and acrilan; lower alkali concentration being required to avoid this. Washfastness tests (BS1006 ISO C06 C2) were carried out on kevlar, polyester and cotton and the results are shown in Table 5.

TABLE 5

| FABRIC | STAINING/SCORE | STAINING/SCORE |
|---|---|---|
| Kevlar | Cotton (5) | Kevlar (5)+ |
| Polyester | Cotton (5) | Polyester (5) |
| Cotton | Cotton (5) | Cotton (5) |
| Nylon | Cotton (5) | Nylon (5) |

Example 12

Dyeing of nylon microfibres using CI Vat Yellow 33: washfastness studies

Further to these fabrics, nylon microfibre, known to have poorer washfastness than conventional nylon, was dyed using 0.1 g Dye Vat Yellow 33, 2 g Rongal HT and 10 ml 8M sodium hydroxide in 60 ml water; a final sodium hydroxide concentration of 1.14 molar. After oxidisation and soaping as described previously the fabric was subjected to BS1006 ISO C06 C2 washfastness testing and scored a perfect '5'.

Example 13

Critical reducing agent:alkali ratio using Rongal HT and sodium hydroxide: Rongal concentration It is expected that as the depth of shade increases that the staining of adjacent fabrics in the washfastness test increases. This complicates the situation since as the reducing agent concentration is decreased the fabrics dye to a lighter shade, although staining also gets worse. Table 6 below clearly shows that the reduction in Rongal HT concentration affects the manner in which dye is bonded to fibre.

Nylon microfibre (1.5 g) was dyed at 95° C. for 45 minutes using 0.1 g Vat Yellow 33, 10 ml of 8M sodium hydroxide and 60 ml water with varying amounts of Rongal HT; final sodium hydroxide concentration was 1.14 molar. Oxidation, rinsing and soaping was carried out as described previously.

TABLE 6

EFFECT OF RONGAL HT CONC ON WASHFASTNESS OF NYLON MICROFIBRE

| Rongal (g) | % Reflectance 400 nm | Nylon Staining score | Cotton Staining score | Reduced Nylon colour |
|---|---|---|---|---|
| 0.012 | 33.33 | 3/4 | 5 | 4 |
| 0.12 | 39.65 | 3/4 | 5 | 4/5 |
| 0.27 | 25.04 | 4/5 | 5 | 5 |
| 0.5 | 14.52 | 4/5 | 5 | 5 |
| 1.0 | 6.59 | 5 | 5 | 5 |
| 2.0 | 3.60 | 5 | 5 | 5 |

The most sensitive indicator was the staining of adjacent nylon microfibres. It can be seen that the amount of dye on the fabric is very low at low levels of Rongal HT and the washfastness also is low. To be sure of good washfastness for nylon microfibre of this example Rongal HT should be used at 14 g/liter.

Example 14

Critical reducing agent:alkali ratio using Rongal HT and sodium hydroxide: sodium hydroxide concentration Nylon microfibre (1.5 g) was dyed at 95° C. for 45 minutes using 0.1 g Vat Yellow 33, 2 g of Rongal HT and 60 ml of water; no alkali was added. The washfastness provided was as follows: Nylon staining score 3, Cotton staining score 4/5, reduced Nylon colour 4.

The pinpointing of any crucial ratio between the alkali and reducing agent is difficult since at fixed alkali concentrations the reduction in concentration of Rongal HT reduces the colour yield on the fabric and results in a lower washfastness score. The same happens for a given Rongal HT concentration if the concentration of alkali is reduced. Rather than a crucial ratio there is a processing window in which various alkali to Rongal HT combinations can yield similar results. Furthermore, such windows are dye specific.

Example 15

Dyeing of Nylon microfibre with reduced amount of Vat Black 7 (0.1 g)

The same experiment was repeated as above but using 10 ml 8M sodium hydroxide with Vat Black 7 (0.1 g) and variable Rongal HT: results are given in Table 7 below.

TABLE 7

EFFECT OF RONGAL HT ON WASHFASTNESS OF NYLON MICROFIBRE

| Rongal (g) | % Reflectance 400 nm | Nylon Staining score | Cotton Staining score | Reduced Nylon colour |
|---|---|---|---|---|
| 0.5 | 9.93 | 3/4 | 4/5 | 4/5 |
| 1.0 | 5.71 | 4 | 4/5 | 4/5 |
| 2.0 | 3.34 | 5 | 5 | 5 |

TENSILE STRENGTH OF VAT BLACK 7 DYED TASLAN FABRIC DYED ACCORDING TO THE INVENTION

Tensile strength testing of Taslan fabric dyed using the method of the invention using relatively extreme conditions in order to demonstrate that the fabric was not tenderised by the process.

The dyeing treatment used the method of Example 1 except that the recipe used consisted of Vat Black 7 (4 g), water (50 ml), sodium hydroxide (8M, 30 ml), Rongalite C (5 g) and 1 g Taslan fabric.

Yarns were removed from Taslan dyed as above and undyed Taslan fabric and the tensile strength of each measured. Table 8 below shows the average breaking force and elongation at break for the tested samples, ten yarns from each fabric being taken with the test length being ten centimeters. This test is more convenient than measuring the tensile strength of the fabric strips themselves and should be a more sensitive check for tendering.

TABLE 8

| SAMPLE | MEAN ELONGATION % | ELONGATION VARIANCE | MEAN FORCE AT BREAK cN | VARIANCE | MAX FORCE AT BREAK |
|---|---|---|---|---|---|
| Undyed | 32.94% | 8.73% | 510.40 | 2.96 | 532.71 |
| Dyed | 34.08% | 7.36% | 526.07 | 2.89 | 558.10 |

Clearly no tenderising occurs with Taslan (nylon) with indications being provided that the fibres actually become stronger as evaluated by this particular test.

EXAMPLES OF PRINTING USING THE METHOD OF THE INVENTION

Printing pastes as described below were applied by standard pattern application methods, then steamed at 115° C. for 15 minutes before being allowed to dry. Dried prints were allowed to oxidise and then soaped and washed as described in the vat dyeing examples above.

Example 16

Printing Nylon (Taslan) using Vat Green 1

A printing paste was mixed consisting of Vat Green 1 (0.6 g); Rongalite C (0.5 g); sodium hydroxide (8M, 3 ml); water (5 ml) and Polyprint (RTM) thickener (available from Rudolph Chemicals, Derbyshire, UK. The mixed paste was applied to Taslan fabric and treated using a steaming, drying, oxidising, soaping and washing regime as described immediately above and in the Vat Dyeing Examples.

The resulting dyed fabric had a reflectance value 20% or below between 400 and 800 nm, rising to 46% at 1000 nm.

Example 17

Printing Nylon (Taslan) using Vat Yellow 33

A printing paste was mixed consisting of Vat Yellow 33 (0.6 g); Rongalite C (0.5 g); sodium hydroxide (8M, 3 ml); water (5 ml) and Polyprint (RTM) thickener. The mixed paste was applied to Taslan fabric and treated using the steaming, drying, oxidising, soaping and washing regime as described above and in the Examples of Vat dyeing.

The resulting dyed fabric was a bright yellow and had reflectance values below 10% between 400 and 460 nm, below 15% at 480 nm, rising to about 50% between 500 and 1000 nm.

Example 18

Printing Nylon (Taslan) using Vat Blue

A printing paste was mixed consisting of Vat Blue (0.6 g); Rongalite C (0.5 g); sodium hydroxide (8M, 3 ml); water (5 ml) and Polyprint (RTM) thickener. The mixed paste was applied to Taslan fabric and treated using the steaming, drying, oxidising, soaping and washing regime as described above and in the Examples of Vat dyeing.

The resulting dyed fabric was a blue/purple colour and had reflectance values 12% or below between 400 and 660 nm, below 30% between 660 and 720 nm, rising to about 44% between 720 and 1000 nm.

Example 19

Printing Nylon (Taslan) using Vat Black 7

A printing paste was mixed consisting of Vat Black 7 (0.6 g); Rongalite C (0.5 g); sodium hydroxide (8M, 3 ml); water (5 ml) and Polyprint (RTM) thickener. The mixed paste was applied to Taslan fabric and treated using the steaming, drying, oxidising, soaping and washing regime as described above and in the Examples of Vat dyeing.

The resulting dyed fabric was a strong black colour and had reflectance values 5% or below between 400 and 700 nm, below 10% between 700 and 820 nm, rising to about 15% between 820 and 1000 nm.

Example 20

Immersion dyeing of Taslan (nylon) using acid dyes under alkaline conditions of the invention Brown dyed washfast and lightfast Taslan was provided using the procedure set out in Example 1 except in that the recipe of the dye solution consisting of Acid Black (2 g); Rongal HT (5 g); sodium hydroxide (8M, 30 ml); water (50 ml); Taslan (1 g).

Example 21

Immersion dyeing of Nomex using Vat dyes by method of the invention for the purpose dyeing materials olive The flame retardant polyarylamide Nomex was dyed to give an olive colouration suitable for military camouflage use as using the conditions set out in the Example 5 above using the recipe below with the boiling temperature being 135° C. for 45 minutes: Recipe: CI Vat Black 7 (0.5 g); CI Vat Green 1 (2.0 g); CI Vat Black 27 (0.5 g) Water (40 ml); NaOH 8M (20 ml); Rongal HT (3.0 g); Nomex (1.0 g). The dyed fabric produced had washfastness by ISO C06 C2 as follows: staining adjacent cotton—5; staining adjacent nomex—5; change in the shade—5. The lightfastness was measured as 6. The infra-red reflectance of the product was below 12% up to 680 nm and below 35% up to 100 nm.

Example 22

Immersion dyeing of Lycra

The polyurethane fabric lycra was dyed by the method of Example 5 of the invention the fabric being in the form of a polyester-lycra blend sold commercially. Two values of temperature, 100° C. and 110° C. were used for the reducing agent/alkali step using the same recipe given below: Recipe. CI Vat Brown 33 (2 g); Rongal HT (5 g); NaOH 8M (30 ml); Water (50 ml); Polyester-Lycra (3 g).

Using 100° C. for the reducing agent/alkali step gave ISO C06 C2 washfastness values of 5 with adjacent cotton staining; 5 with adjacent Lycra staining and a change in shade of 5. Infra-red reflectance values were below 20% up to 680 nm and below 30% up to 100 nm. Increasing the temperature of the reducing agent/alkali step to 110° C. also gave the high washfastness required but still further decreased the infra-red reflectance such that reflectance up to 720 nm was 20% or less and up to 100 nm was lower than the 100° C. value. Lightfastness in both cases was greater than 5.

BRITISH STANDARD METHODS OF TEST FOR COLOUR FASTNESS OF TEXTILES AND LEATHER: BS1006

These tests are more fully explained in publications available from the British Standards Institute, but a brief summary is given here.

BS1006 ISO B01: 1978 This method is intended for determining the resistance of the colour of textiles of all kinds and in all forms, and of leather, to the action of daylight. The principle of the test is that a specimen of the textile or leather is exposed to daylight along with 8 dyed wool standards and the fastness assessed by comparing change of colour with these.

Two sets of blue standards may be used but are not interchangeable; these are CI Standards 1 to 8 (Europe) or L Standards 2 to 9 (USA): Blue standards developed and produced in Europe are dyed with respective ones of the following eight dyes: 1: CI Acid Blue 104; 2: CI Acid Blue 109; 3: CI Acid Blue 83; 4: CI Acid Blue 121; 4: CI Acid Blue 121; 5: CI Acid Blue 47; 6: CI Acid Blue 23; 7: CI Solubilized Vat Blue 5; 8: CI Solubilized Vat Blue 8. All these dyes and those used in Experiments 1 to 15 are listed in The Colour Index (eg. 3rd Edition) published by the Society of Dyers and Colourists, PO Box 244, Perkin House, 82 Grattan Road, Bradford BD1 2JB, West Yorkshire, United Kingdom. The L2 to L9 dyes are prepared by blending varying proportions of wool dyed with CI Mordant Blue 1 (Colour Index, 3rd Edition, 43830) and wool dyed with CI Solubilized Vat Blue 8 (Colour Index, 3rd Edition, 73801) so that each higher numbered standard is approximately twice as fast as the preceding standard.

Equipment needed includes an exposure rack facing toward the the sun (South in the Nothern hemisphere, North in the Southern hemisphere), sloping at an angle from the horizontal approximately equal to the latitude of the location of testing. The rack should preferably be sited in a non-residential and non-industrial area free from dust and automobile exhaust fumes, where shadows do not fall on the textiles. Textiles should be covered with window glass of at least 90% transparency between 380 nm and 700 nm, falling to 0% between 310 nm and 320 nm. Air ventilation behind the textiles should be provided. The minimum permissible distance between the glass and specimens is 5 cm and the useable exposure area is limited to that of the glass cover reduced on each side by twice the distance from cover to specimen.

Opaque cardboard or other thin material such as aluminium foil is required; a cover which avoids compression being required for pile fabrics. A Grey scale for assessing colour change is also needed.

Test specimens of textile are prepared not less than 1 cm×6 cm or 1×10 cm depending on whether BSI Method 1 or 2 is applied, and the Blue Standards are similarly proportioned.

Exposure: specimens are exposed to daylight for 24 hours per day. In Method 2, used herein, specimens are arranged in strips adjacent standards and two spaced 1/5th areas of each simultaneously covered with the opaque material. When a change in Standard 3 or L2 is perceived equal to 4–5 on the grey scale on lifting the cover, the specimens rate and light fastness are inspected and compared with Standards 1 to 3 or L2. The cover is replaced and the exposure continued until a change in Standard 4 or L3 is perceived at which point an additional cover is placed overlapping one of the first covers and some of each of the specimens until a change in Standard 6 or L5 is perceived, equal to grey Scale 4–5, before a final cover is overlapped on the second cover. With the four covers on, exposure is continued until a contrast on Standard 7 or L7 equals the contrast illustrated by grey scale 4; or a contrast equal to grey scale grade 3 is produced on the most resistant specimen; whichever occurs first.

The final assessment in numerical ratings is based upon contrasts equal to grey scale 4 and/or 3 between exposed and unexposed portions of the specimen. All the covers are removed to reveal three areas on the Standards and specimens that have been exposed for different times, together with at least one area that has not been exposed to light. The changes are compared to the changes of the Standards at 6001× or more falling at 45° to the sample; light fastness being that of the standard which matches the change in colour. Change of colour may be change of hue, depth, brightness or any combination of these.

The Blue wool standards used for the present examples may be obtained form British Standards Institution, 10 Blackfriars Street, Manchester M3 5DT, UK; Beuth-Vertrieb, Burggrafenstr. 4-7, D-1000 Berlin 30 Germany and Japanese Standards Association, 1-24 Akasaka 4, Minatoku Tokyo Japan. The L Blue Wool Standards are available from American Association of Textile Chemists and Colorists, PO Box 12215, Research Triangle Park, N.C. 27709, USA.

BS1006: ISO B02 (178)

This method is intended to assess lightfastness to artificial light using the standards applied above.

Apparatus used includes a well ventilated exposure chamber and a xenon arc lamp of correlated colour temperature 5500 K. to 6500 K., with a light filter between source and specimens to steadily reduce UV spectrum. Glass used should have transmission of at least 90% between 380 nm and 750 nm falling to 0% at 310 nm to 320 nm. Infrared radiation also needs to be filtered with a black panel maximum of 45° C. variation of light intensity over the exposed surfaces should not be more than ±10% from the mean.

An area of textile of not less than 1 cm×4.5 cm is used when several exposures are made side by side on the same specimen.

Method 2 was used in the present examples: Specimens were arranged with standards as for ISO B01 but with only one cover which extends over one quarter of each specimen and standard. When the change in Standard 3 can just be perceived, equal to grey scale 4–5, the specimens are inspected and light fastness rated by comparison with Standards 1 to 3. The cover is replaced until Standard 4 just equals grey scale 4–5 when an additional cover is fixed in overlapping manner over a portion of all the specimens and standards. Exposure is continued until a change in Standard 6 is perceived to match grey scale 4–5 when a third cover is positioned to overlap the second and some of the uncovered specimens and standards. Exposure is continued until a contrast is produced on Standard 7 equal to the contrast illustrated by 4 on the grey scale or a contrast equal to grey scale 3 has been produced on the most resistant specimen; whichever occurs first.

The final assessment is based upon a contrast equal to grey scale 4 and/or 3 between exposed and unexposed portions of specimen. All covers are removed and the light fastness is the number of the standard which shows a similar change in colour.

BS1006: ISO C06 (1981)

Details of this test are available from the British Standards Institute (see address above). It is based upon laundering, rinsing and drying under set conditions of temperature, alkalinity, bleaching and abrasive action; the latter provided by throw, slide and impact together with a number of steel balls. Change in colour is assessed by reference to the Grey scales with the fabric assessed for transfer of colour to adjacently placed fabrics such as cotton and unstained fabric of the sample; assessment is of the adjacent fabric change in colour.

We claim:

1. A method of vat-dyeing a non-cellulosic organic material such that the resulting dyed material has one or both of the following properties:

(i) a washfastness by British Standard Test BS1006 C06C2 (1981) of 5 or more, or (ii) a lightfastness by British Standard Test BS1006 B01 and B02 (1978) of 5 or more, said method comprising the following steps:

(a) selecting a vat dye, (b) treating the material with said dye in the presence of a reducing agent and an alkali, said alkali being at a concentration of greater than 0.5M, and (c) oxidising the treated material produced in step (b).

2. A method as claimed in claim 1 wherein the material is a synthetic organic material.

3. A method as claimed in claim 2 wherein the material is selected from a polyarylamide, nylon, polyester, polypropylene, polyurethane, acetate, 2°-acetate, triacetate and acrilan.

4. A dyed material obtained by the method of claim 1.

5. A method as claimed in claim 1 wherein the alkali is at a concentration of 1 molar or more.

6. A method as claimed in claim 5 wherein the alkali is at a concentration of between 1 and 4 molar.

7. A method as claimed in claim 1 wherein the ratio of reducing agent to alkali in step (b) is greater than the reducing equivalent of 0.001 moles sodium dithionite per 0.01 moles sodium hydroxide or equivalent alkali for 0.1 to 10 grams vat dye.

8. A method as claimed in claim 1 wherein the dye selected in step (a) is such that the resulting dyed material has improved visual and near infra-red camouflage reflectance properties.

9. A method as claimed in claim 1 wherein the dye is applied in step (b) by immersion in an aqueous solution of alkali and reducing agent at a temperature of between 90° C. and 100° C.

10. A method as claimed in claim 1 wherein the dye is applied in step (b) by printing by applying a paste including the dye, sodium hydroxide and reducing agent to the material and then applying steam at between 100° and 140° C.

11. A method as claimed in claim 1 wherein the dye selected in step (a) is a Vat Black dye.

12. A method as claimed in claim 11 wherein the dye selected in step (a) is such that the resultant dyed material has a reflectance of light of 10% or less at 400 to 680 nm and of 65% or less at 700 nm to 1200 nm.

13. A method as claimed in claim 11 wherein the dye selected in step (a) is such that the resultant material is dyed khaki and has a reflectance of light of 65% or less at 700 nm to 1200 nm.

14. A method as claimed in claim 11 wherein the dye selected in step (a) is such that the resultant material is dyed green has a reflectance of light of 50% or less at 700 nm to 1200 nm.

15. A method as claimed in claim 11 wherein the dye selected in step (a) is such that the resultant material is dyed brown and has a reflectance of light of 27.5% or less at 700 nm to 1200 nm.

16. A method as claimed in claim 11 wherein the dye selected in step (a) is such that the resultant material is dyed black and has a reflectance of light of 12.5% or less at 700 nm to 1200 nm.

17. A visual and near infra-red camouflage material consisting of a vat-dyed non-cellulosic organic material having a reflectance of light of 10% or less at 400 to 680 nm and of 65% or less at 700 nm to 1200 nm.

18. A material as claimed in claim 17 having a reflectance of light of 50% or less at 700 nm to 1200 nm.

19. A material as claimed in claim 18 having a reflectance of 27.5% or less at 700 nm to 1200 nm.

20. A material as claimed in claim 19 having a reflectance of 12.5% or less at 700 nm to 1200 nm.

21. A material as claimed in claim 17 wherein the material is a Vat Black dyed material.

22. A material as claimed in claim 17 having a washfastness by British Standard Test BS1006 C06C2 (1981) of 5 or more.

23. A material as claimed in claim 17 having a lightfastness by British Standard Test BS1006 B01 and B02 (1918) of 5 or more.

24. A material as claimed in claim 23 having a lightfastness by British Standard Test BS1006 B01 and B02 (1978) of 7 or more.

25. A material as claimed in claim 17 being selected from a polyarylamide, nylon, polyester, polypropylene, polyurethane, acetate, 2°-acetate, triacetate and acrilan.

26. A material as claimed in claim 25 wherein the material is a nylon microfibre material.

* * * * *